US009999817B2

(12) United States Patent
Pourshakour

(10) Patent No.: US 9,999,817 B2
(45) Date of Patent: Jun. 19, 2018

(54) DEVICE IN CONNECTION WITH EXERCISE

(71) Applicant: Shahram Pourshakour, Solna (SE)

(72) Inventor: Shahram Pourshakour, Solna (SE)

( * ) Notice: Subject to any disclaimer, the term of this patent is extended or adjusted under 35 U.S.C. 154(b) by 63 days.

(21) Appl. No.: 14/893,425

(22) PCT Filed: May 22, 2014

(86) PCT No.: PCT/SE2014/050631
§ 371 (c)(1),
(2) Date: Nov. 23, 2015

(87) PCT Pub. No.: WO2014/189460
PCT Pub. Date: Nov. 27, 2014

(65) Prior Publication Data

US 2016/0107058 A1 Apr. 21, 2016

(30) Foreign Application Priority Data

May 23, 2013 (SE) ..... 1300374

(51) Int. Cl.

| | |
|---|---|
| ***A63B 21/00*** | (2006.01) |
| ***A63B 26/00*** | (2006.01) |
| ***A63B 69/00*** | (2006.01) |
| ***A63B 23/02*** | (2006.01) |

(52) U.S. Cl.
CPC ..... *A63B 69/0059* (2013.01); *A63B 21/4011* (2015.10); *A63B 21/4039* (2015.10); *A63B 23/0211* (2013.01); *A63B 21/00047* (2013.01); *A63B 2069/0062* (2013.01); *A63B 2208/0247* (2013.01); *A63B 2225/09* (2013.01)

(58) Field of Classification Search
CPC .... A63B 2069/0059; A63B 2069/0062; A63B 21/4011; A63B 21/4039; A63B 23/0211; A63B 23/03508; A63B 69/0057; A63B 69/0059
USPC ..... 602/26
See application file for complete search history.

(56) References Cited

U.S. PATENT DOCUMENTS 4,314,697 A 2/1982 Brumfield et al.
4,407,496 A * 10/1983 Johnson ..... A63B 23/0494 482/139
4,483,533 A * 11/1984 Mangiapane ..... A63B 21/0455 482/122

(Continued)

FOREIGN PATENT DOCUMENTS

EP 0 888 798 A1 1/1999
GB 2 314 782 A 1/1998

(Continued)

OTHER PUBLICATIONS

Supplementary European Search Report issued in Application No. 14800559.8, dated Feb. 3, 2017.

(Continued)

*Primary Examiner* — Nyca T Nguyen
(74) *Attorney, Agent, or Firm* — Young & Thompson

(57) ABSTRACT

A device in connection with exercise, includes a base body (1) and elements (11) for applying the base body (1) in the fold of the knee of a user. The base body (1) includes two supporting surfaces (5, 7) that form an intermediate angle ($\alpha$) that is in the interval $70° < \alpha < 110°$, and that the elements to apply the base body (1) on a user (A) include at least one band (11) that may form or forms a closed loop relative to the base body (1).

10 Claims, 26 Drawing Sheets

(56) References Cited

U.S. PATENT DOCUMENTS

| | | | | | |
|---|---|---|---|---|---|
| 4,784,121 | A * | 11/1988 | Brooks | A61H 1/0237 | 482/131 |
| 4,844,454 | A * | 7/1989 | Rogers | A61H 1/024 | 482/131 |
| 4,981,132 | A * | 1/1991 | Chong | A61F 5/0585 | 602/23 |
| 5,009,417 | A | 4/1991 | Sarkozi | | |
| 5,031,905 | A * | 7/1991 | Walsh | A63B 21/00072 | 482/112 |
| 5,669,862 | A * | 9/1997 | Sayman | A63B 21/0455 | 482/127 |
| 5,800,371 | A * | 9/1998 | Winn | A61F 5/3715 | 473/207 |
| 6,231,487 | B1 | 5/2001 | Diamond, Jr. et al. | | |
| 7,762,936 | B2 * | 7/2010 | Conley | A61H 1/0244 | 482/131 |
| 9,498,399 | B1 * | 11/2016 | Juntunen | A61H 1/024 | |
| 2005/0107225 | A1 | 5/2005 | Diamond, Jr. | | |
| 2006/0128539 | A1 | 6/2006 | Marquez | | |
| 2006/0167394 | A1 * | 7/2006 | Ceriani | A61F 5/0123 | 602/16 |
| 2009/0017995 | A1 * | 1/2009 | Freiberg | A61H 1/024 | 482/91 |

FOREIGN PATENT DOCUMENTS

| | | | |
|---|---|---|---|
| KR | 20-0454037 | A1 | 6/2011 |
| WO | 99/17841 | A1 | 4/1999 |

OTHER PUBLICATIONS

International Search Report, dated Oct. 7, 2014, from corresponding PCT Application.

* cited by examiner

DEVICE IN CONNECTION WITH EXERCISE

TECHNICAL FIELD OF THE INVENTION

The present invention relates to a device in connection with exercise, the device comprising a base body and means for applying the base body in the fold of the knee of the user.

PRIOR ART

From WO9917841 is previously known a supporting device for the legs of the user when performing sit-ups. The device is fastened in the fold of the knee of the user by loops that extend around the ankles of the user. The device also comprises a disc that abuts the buttocks of the user and a flexible portion that extends between the loops and the disc. However, it should be noted that the user rests his/her feet against the floor and that the angle that the device defines in the fold of the knee of the user is in the magnitude of 90°.

From KR 200454037 a device when exercising so called sit-ups is previously known. The device is intended to rest on a floor and the user lies on top of the device. The device comprises a generally triangular portion that is intended to support the legs of the user when exercising sit-ups. A fastening of the triangular portion to the legs of the user is not necessary.

OBJECTS AND FEATURES OF THE INVENTION

A primary object of the present invention is to disclose a device in connection with exercise that primarily is used to support the lower leg of the user in connection with exercise.

A further object of the present invention is that the device is mobile and is in a simple way fastened in the fold of the knee of the user.

Still an object of the present invention is to give the device a simple structural design that is relatively inexpensive to manufacture.

A further object of the present invention is to manufacture it in one or a few sizes.

BRIEF DESCRIPTION OF THE DRAWINGS

Below preferred embodiments of the invention will be described, reference being made to the accompanying drawings, where.

DETAILED DESCRIPTION OF PREFERRED EMBODIMENTS OF THE INVENTION

Figure 1:
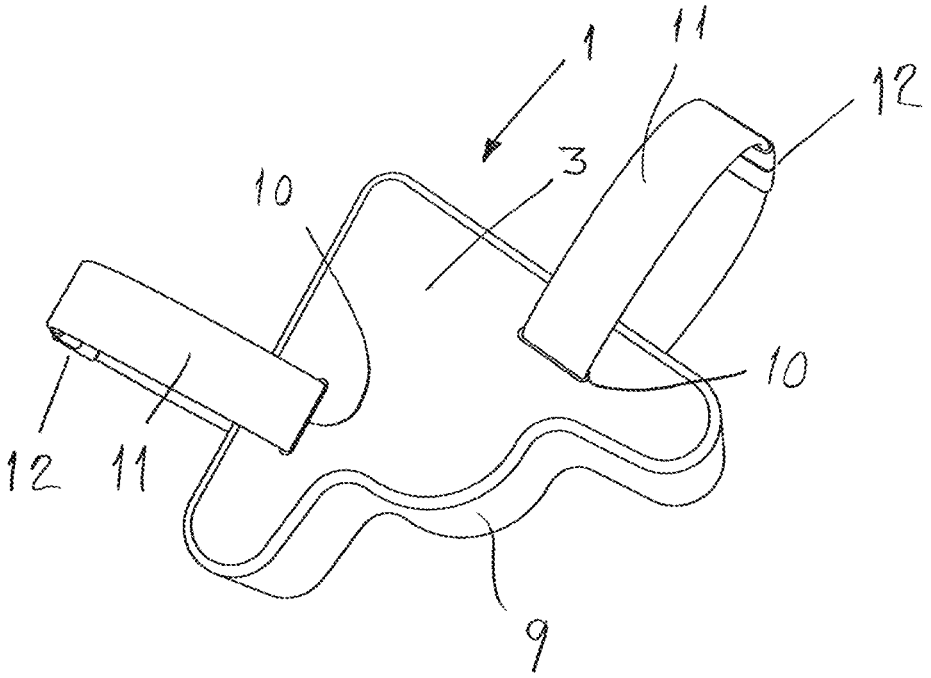
FIG. 1 shows a perspective view of a first embodiment of the device according to the present invention.
Figure 2:
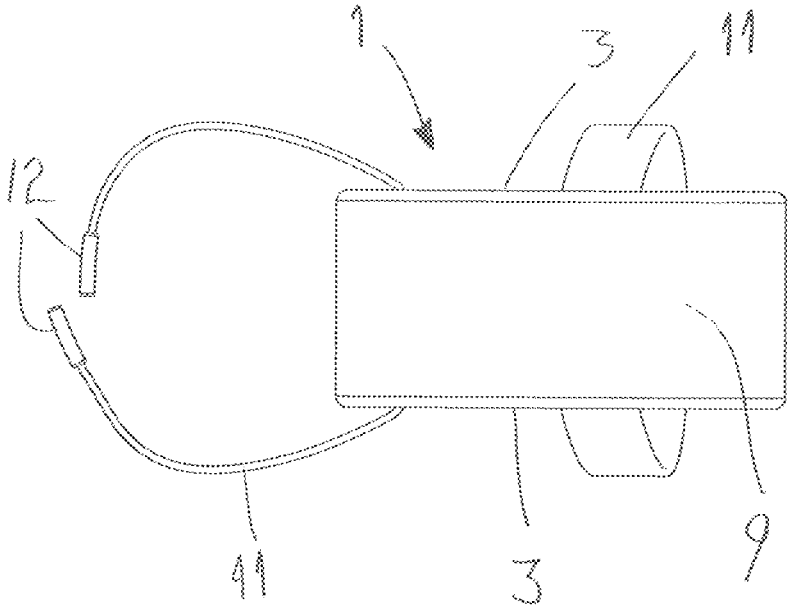
FIG. 2 shows a side view of the device according to FIG. 1.
Figure 3:
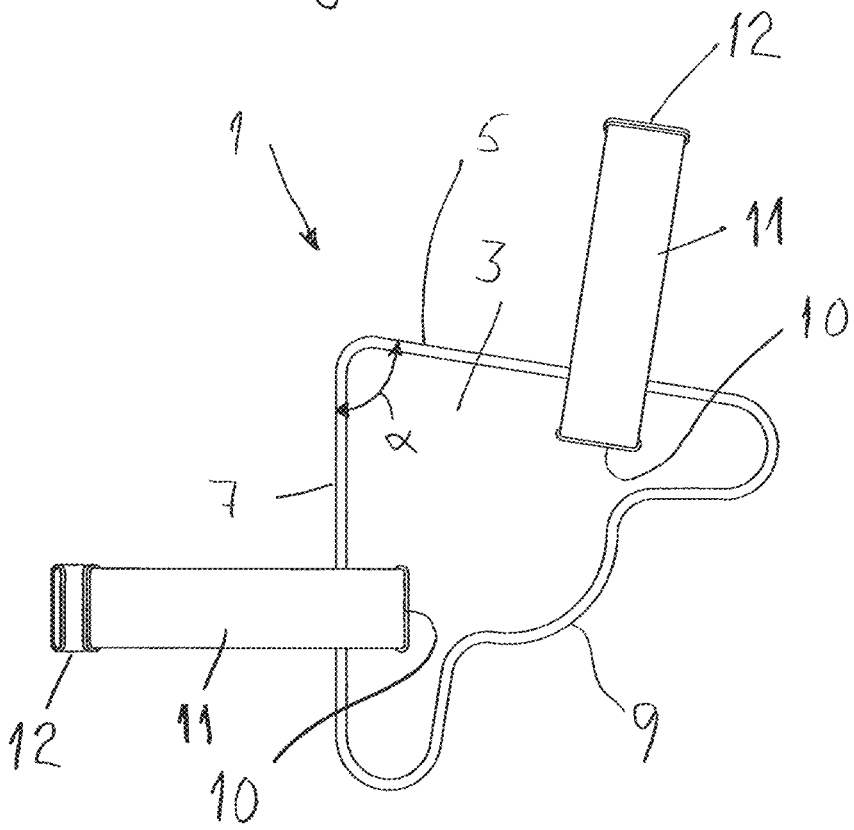
FIG. 3 shows a further side view of the device according to FIG. 1.

The embodiment of the device that is shown in FIGS. 1-3 comprises a base body 1 of generally triangular shape, the base body 1 defining two essentially parallel side surfaces 3 and three edge surfaces 5, 7 and 9 that extend between the essentially parallel side surfaces 3. According to the disclosed embodiment two of the edge surfaces 5, 7 are planar and define an intermediate angle $\alpha$ that according to the disclosed embodiment is acute, more precisely the angle is $80° < \alpha < 90°$. The two edge surfaces 5, 7 constitute supporting surfaces for one leg of the user. This will be described below. The third edge surface 9 is wave shaped in the embodiment disclosed in FIGS. 1-3.

As is evident from FIGS. 1-3 two through-going slots 10 are provided in the base body 1, and hence the slots 10 emanate in both side surfaces 3 of the base body 1. According to the disclosed embodiment the slots 10 have an elongated cross-section in order to adapt the cross-sectional shape of the slots 10 to bands 11 that form part of the device according to the present invention. The bands 11 are received in the slots 10. The slots 10 have a longitudinal extension along the respective edge surfaces 5, 7. The width of the bands 11 are adapted to the length of the slots 10, i.e. the width of the bands 11 is normally somewhat smaller than the length of the slots 10. The bands 11 are used to fasten the device according to the present invention in the fold of the knee of the user. The bands 11 are equipped with some kind of buckle 12 or the like so that each band 11 may form a closed loop when the device according to the present invention is fastened in the fold of the knee of the user. This will be described below.

Figure 4:
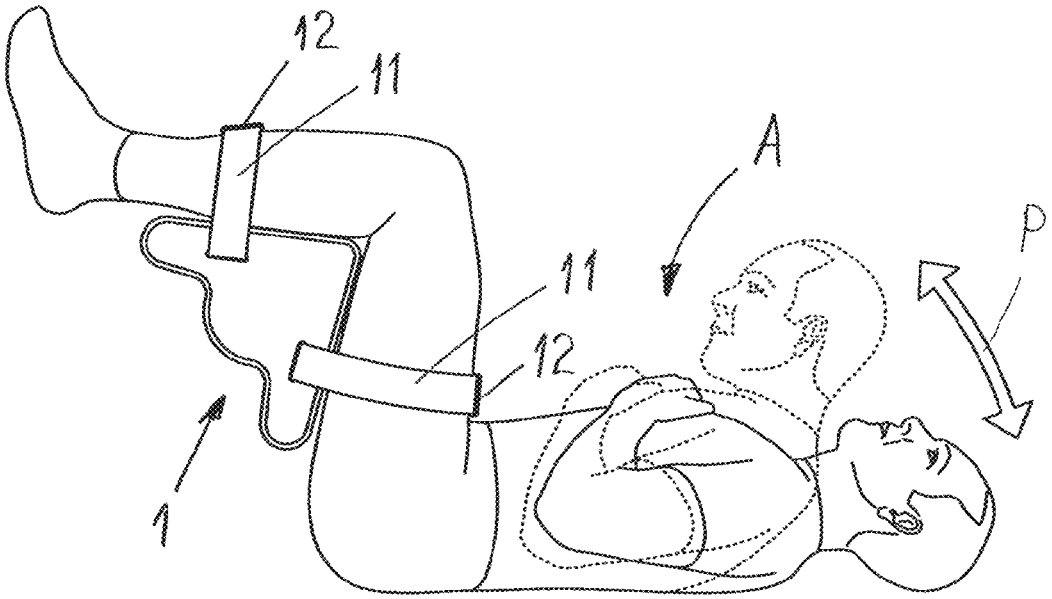
FIG. 4 shows how the device according to the present invention is fastened in the fold of the knee of a user.

In FIG. 4 a preferred use of the device according to the present invention is generally disclosed. As is evident from FIG. 4 the device according to the present invention is applied in the fold of the knee of the user. In this connection it should be pointed out that the embodiment disclosed in FIGS. 1-3 is intended to be used in pairs, i.e. a user uses two devices as shown in FIGS. 1-3 and one device is fastened in each fold of the knees of the user.

In order to guarantee that the device according to the present invention is properly applied in the fold of the knee of the user the bands 11 are used. One band 11 extends around the thigh of the user A while the other band 11 extends around the lower leg of the user A. The bands 11 form loops around the thigh and the lower leg of the user and are tightened to a suitable degree by means of the buckles 12. A full line position of the upper body of the user A defines a starting position for sit-up training while a dotted line position of the upper body of the user A defines an active raised position of the upper body. The double arrow P in FIG. 4 illustrates the motion that the upper body of the user performs in connection with sit-up training.

From FIG. 4 it is evident that the device according to the present invention performs a carrying/supporting function to the user as regards positioning of the lower legs in a preferred position in relation to the thighs.

When applying the device according to the present invention it is beneficial if the user A assumes a sitting position on a floor, the user having his thigh and his lower leg in a mutual angle that roughly corresponds to the angle disclosed in FIG. 4. In this sitting position the user may in a simple way apply the device according to the present invention in the fold of the knee by fastening the device with the aid of the bands 11.

Figure 5:
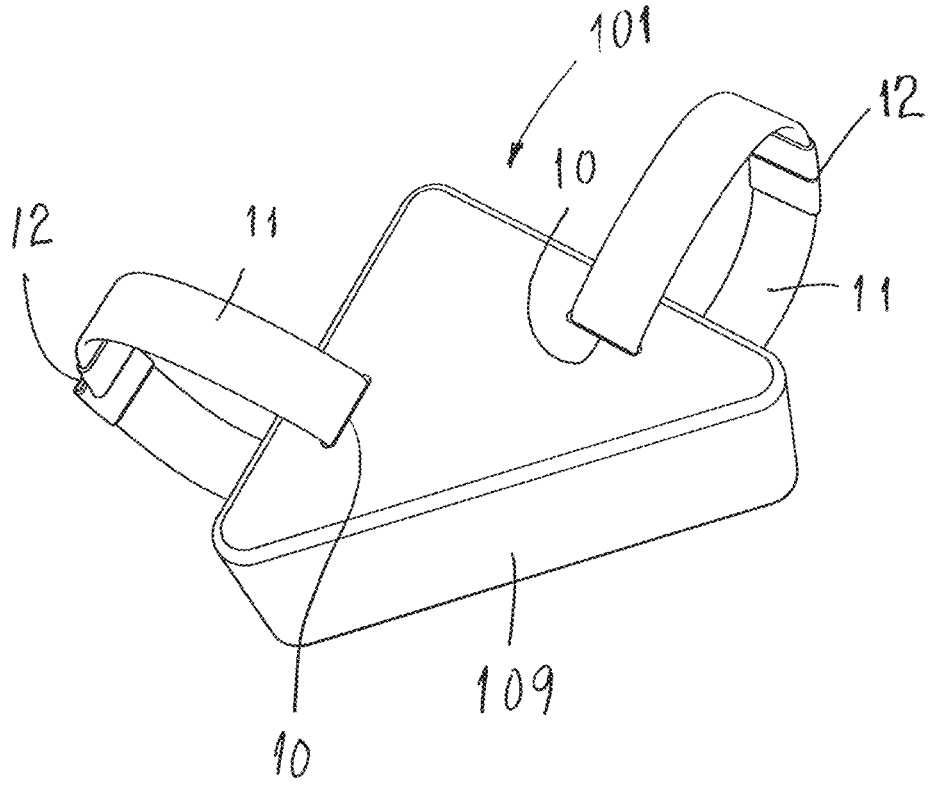
FIG. 5 shows a perspective view of a second embodiment of a device according to the present invention.
Figure 6:
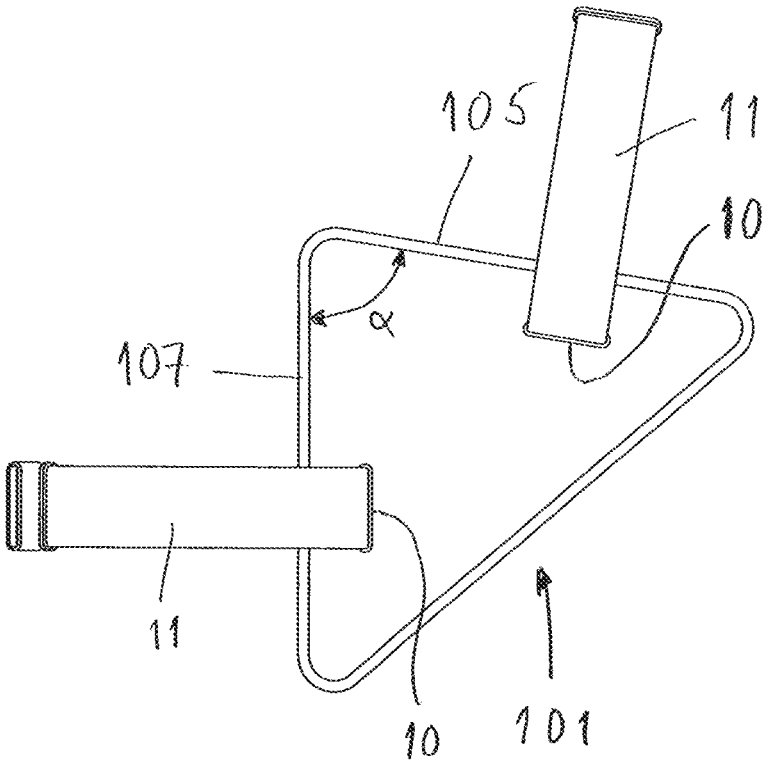
FIG. 6 shows a side view of the device according to FIG. 5.

In FIGS. 5 and 6 a second embodiment of a device according to the present invention is disclosed, the device comprising a base body 101 with generally triangular basic shape, the base body 101 defining two essentially parallel side surfaces 103 and three edge surfaces 105, 107 and 109 that extend between the essentially parallel side surfaces 103. According to the disclosed embodiment two edge surfaces 105, 107 are planar and define an intermediate angle $\alpha$ that according to the disclosed embodiment is acute and more precisely the angle is $80° < \alpha < 90°$. The two edge surfaces 105, 107 constitute supporting surfaces for one leg of the user. In the embodiment disclosed in FIGS. 5-6 the third edge surface 109 is planar.

In a corresponding way as for the device according to FIGS. 1-3 slots 10 are provided in the base body 101 of the embodiment disclosed in FIGS. 5-6. Since these slots in principle may be identical for both embodiments the slots of the embodiment according to FIGS. 5-6 have also been given the reference numeral 10. In the slots 10 bands 11 are received that in principle also may be identical with the bands 11 of the embodiment according to FIGS. 1-3 and for that reason the bands 11 of the embodiment according to FIGS. 5-6 have been given the same reference numeral as the bands 11 of the embodiment of FIGS. 1-3.

As regards the mounting of the device according to FIGS. 5-6 in the fold of the knee of the user A a corresponding procedure is used as has been described above in connection with the embodiment according to FIGS. 1-3 and hence reference is made to that description.

Figure 6A:
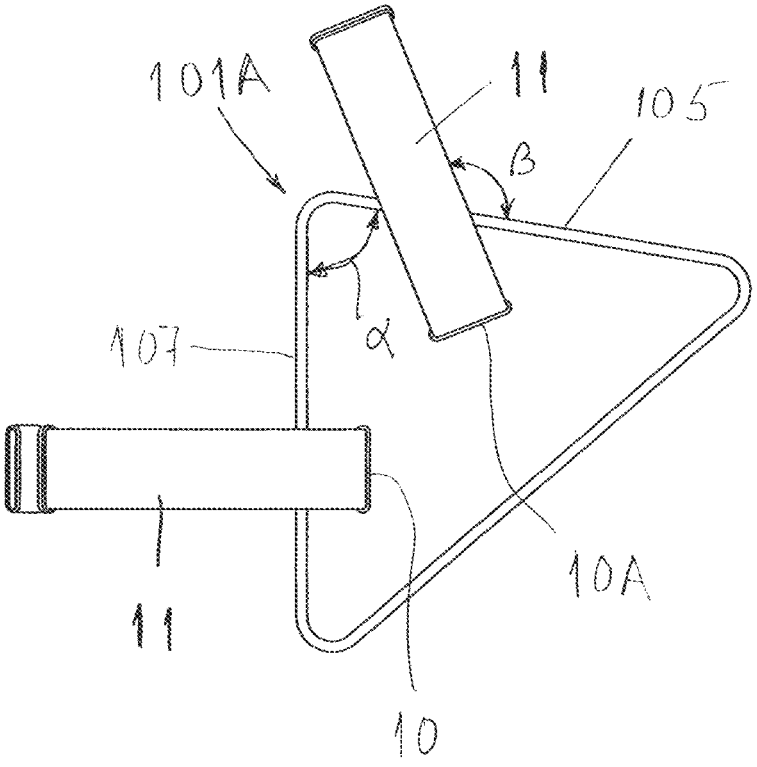
FIG. 6A shows a perspective view of a somewhat modified embodiment of the device according to FIGS. 5-6.

In FIG. 6A a somewhat modified embodiment of the device according to FIGS. 5-6 is disclosed, the base body has been given the reference numeral 101A. Thus, the position of one of the slots 10A has been modified somewhat compared to the embodiment according to FIGS. 5-6. This is most evident by a comparison between FIGS. 6 and 6A. Thus, the slot 10A is not parallel with the adherent supporting surface 105 but the distance between the slot 10A and the edge surface 105 increases in direction towards the other edge surface 107. Thereby, the portion of the band 11 that is furthest away from the base body 101A, said band being received in the slot 10A, will be located in the vicinity of the knee of the user. In order to define the inclination of the band 11 an angle $\beta$ has been introduced in FIG. 6A, said angle $\beta$ being in the interval $90° < \beta < 130°$. The angle $\beta$ is shown in a number of figures below and the given interval applies generally.

Figure 6B:
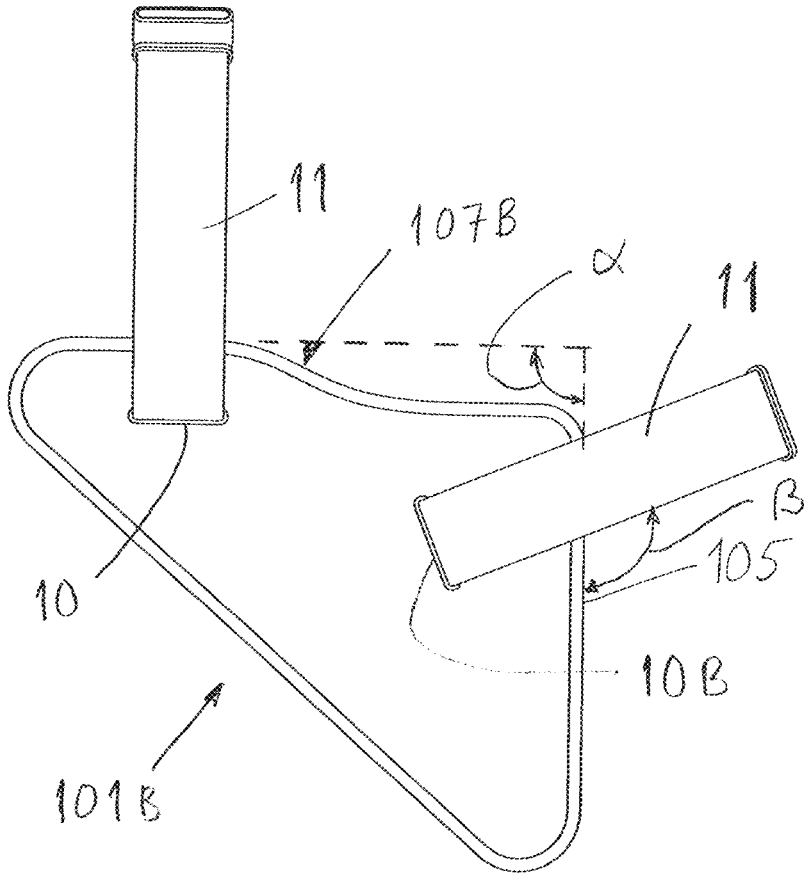
FIG. 6B shows a perspective view of a somewhat further modified embodiment of the device according to FIGS. 5-6.

In FIG. 6B a further modified embodiment of the device according to FIG. 6A is shown, the supporting surface 107B that carries the lower leg of the user is waved to adapt to the calf of the user. As regards the slot 10B in FIG. 6B the positioning is in principle corresponding to the positioning of the slot 10A in FIG. 6A.

Figure 7:
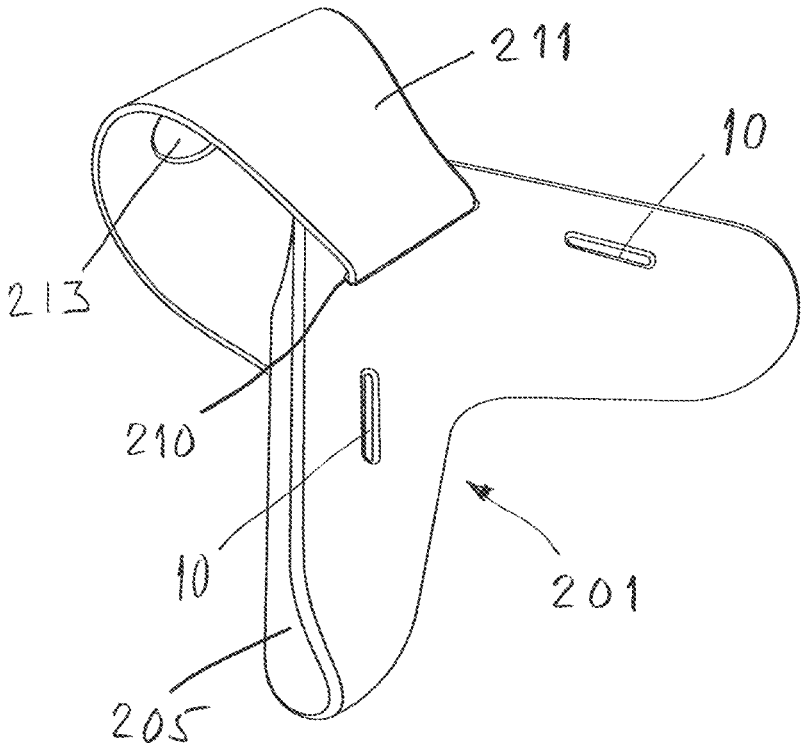
FIG. 7 shows a perspective view of a third embodiment of a device according to the present invention.
Figure 8:
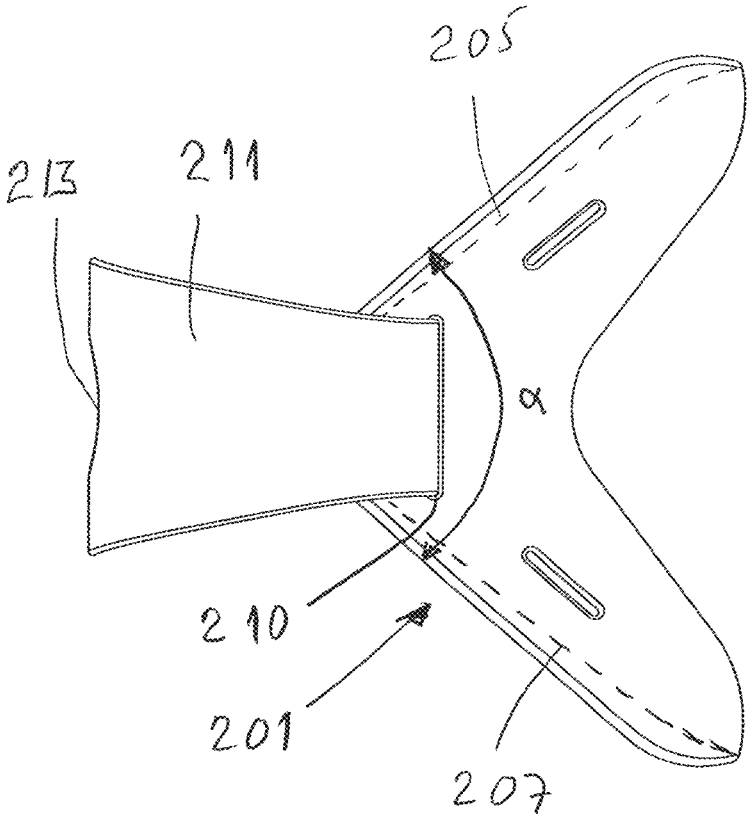
FIG. 8 shows a side view of the device according to FIG. 7.
Figure 9:
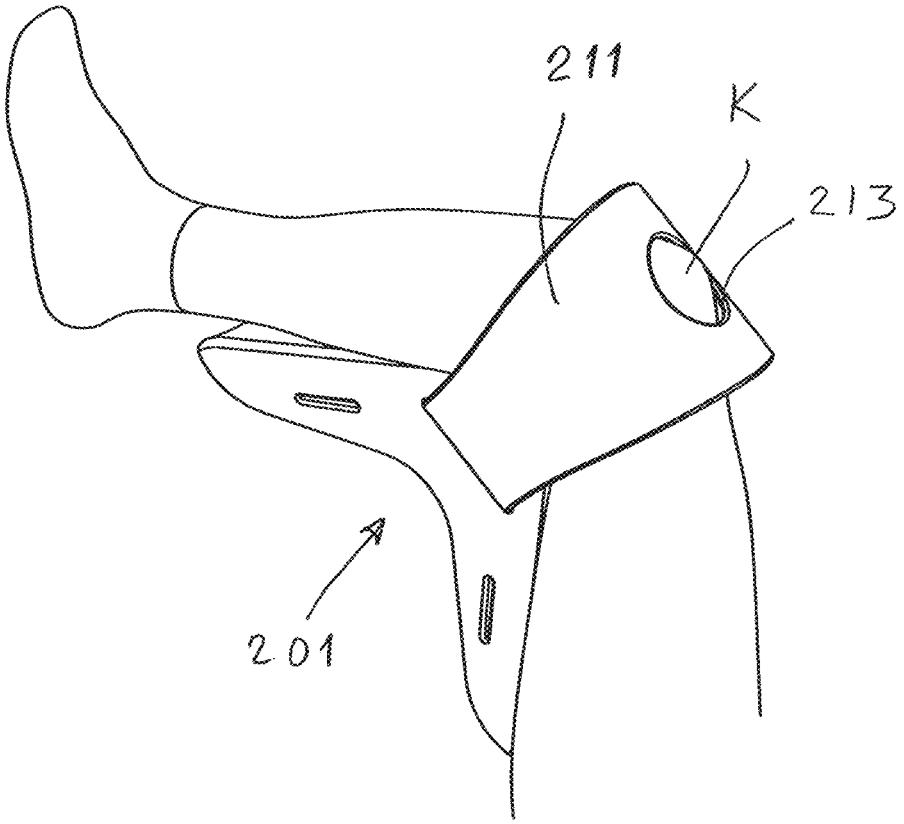
FIG. 9 shows schematically how the device according to the third embodiment is mounted in the fold of the knee of a user.

In FIGS. 7-9 a third embodiment of a device according to the present invention is shown, the device having a base body 201 that generally is in the shape of a V, the base body 201 defining two edge surfaces 205, 207 on the outer side of the legs of the V. According to the disclosed embodiment the two edge surfaces 205, 207 define an intermediate angle $\alpha$ that according to the disclosed embodiment is acute and more precisely the angle is $80° < \alpha < 90°$. The two edge surfaces 205, 207 constitute supporting surfaces for one leg of the user. As is most evident from FIG. 7 the edge surface 205 is concave/hollow in order to be adapted to the portion of the leg of the user that abuts the edge surface/supporting surface 205. The same applies to the edge surface/supporting surface 207, i.e. it is concave/hollow in a generally corresponding way.

In the base body 201 a through-going slot 210 is provided in a central portion of the base body 201. A band 211 is received in the slot 210 and the portion of the band 211 that passes through the slot has a width that is somewhat smaller than the length of the slot 210. According to the disclosed embodiment the portion of the band 211 that is located outside of the slot 210 has a larger width. As is most evident from FIGS. 7 and 9 the band 211 is equipped with an opening 213 that is positioned in the centre of the portion of the band 211 that is located outside the slot 210.

In FIG. 9 it is disclosed how the third embodiment of the device according to the present invention is mounted on a user. Thereby, the band 211 extends over the knee of the user and the kneecap K of the user is received in the opening 213.

The third embodiment of the device according to the present invention is provided with additional slots 10, see FIGS. 7-9, said slots 10 generally corresponding to the slots 10 in the two first embodiments. In these slots the user may mount further fastening bands if he/she so wishes. This is disclosed in FIG. 10 where bands 11 are mounted in the slots 10. These bands are equipped with buckles 12 or the like in order to tighten the bands 11 around the thighs and lower legs of the user.

Figure 10:
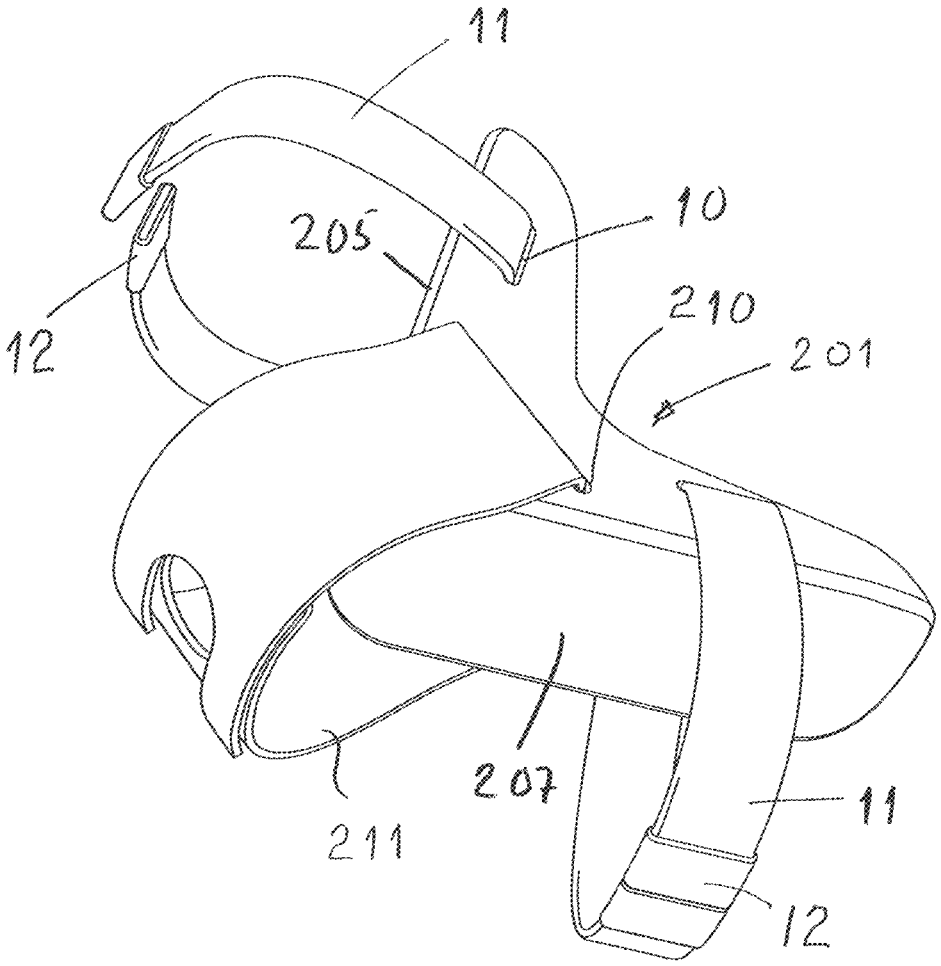
FIG. 10 shows the third embodiment supplied with extra fastening belts.

As regards the angle $\alpha$ in the embodiment according to FIG. 10 it preferably assumes the same values as have been given for the above described embodiments.

Figure 10A:
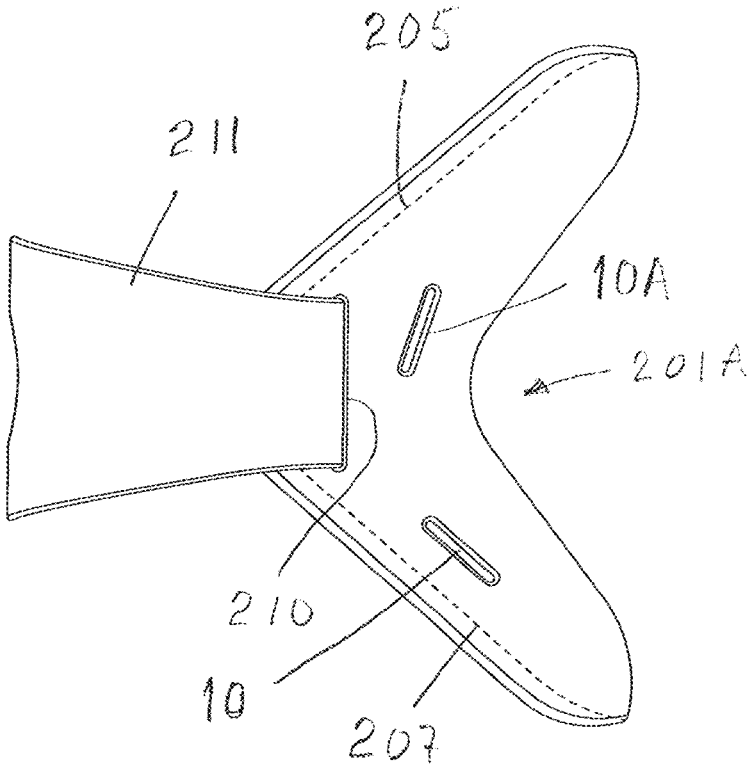
FIG. 10A shows a side view of a somewhat modified embodiment of the device according to FIGS. 7-9.

In FIG. 10A a somewhat modified embodiment of the device according to FIGS. 7-10 is disclosed, the base body has been given the reference numeral 201A. In connection therewith the position of one slot 10A has been somewhat changed compared to the embodiment according to FIGS. 7-10. This being most evident by comparing FIG. 8 and FIG. 10A. Thus, the slot 10A is not parallel with the adherent edge surface 205 but the distance between the slot 10A and the edge surface 205 increases in a direction towards the second edge surface 207. The band that may be mounted in the slot 10*a* will be located in the vicinity of the knee of the user.

Also as regards the embodiments disclosed in FIGS. 5 and 6 and FIG. 6A respectively a modification may be effected, i.e. a variant where the base body 101; 101A is equipped with a further slot in the area of the corner of the base body, this slot corresponding to the slot 210 in the embodiment according to FIG. 7. In this further slot a suitable band is mounted that is intended to extend around the knee cap of the user.

As regards the embodiments disclosed in FIGS. 1-10A the base body may preferably constitute products of polystyrene of the type hard cellular plastic/hard foam plastic, styrofoam, suitable hard plastic.

Figure 11:
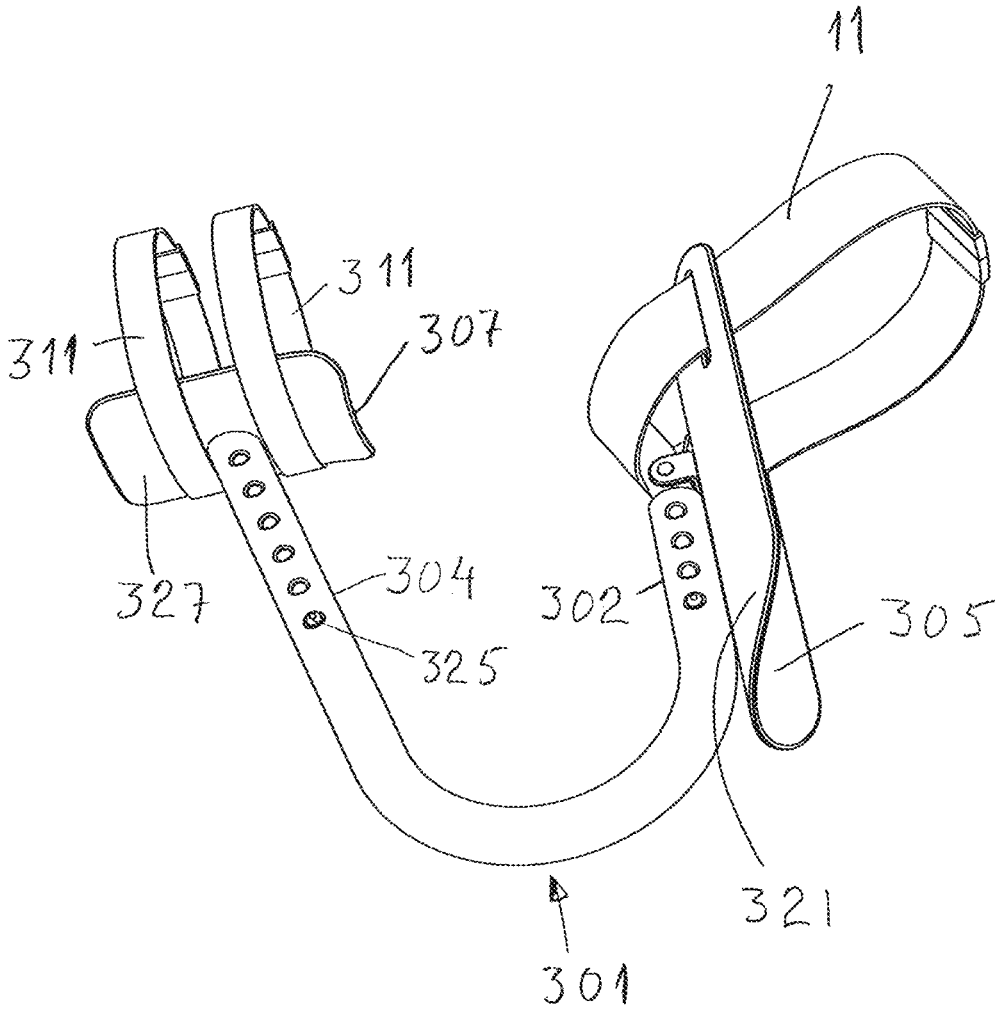
FIG. 11 shows a perspective view of a fourth embodiment of the device according to the present invention.
Figure 12:
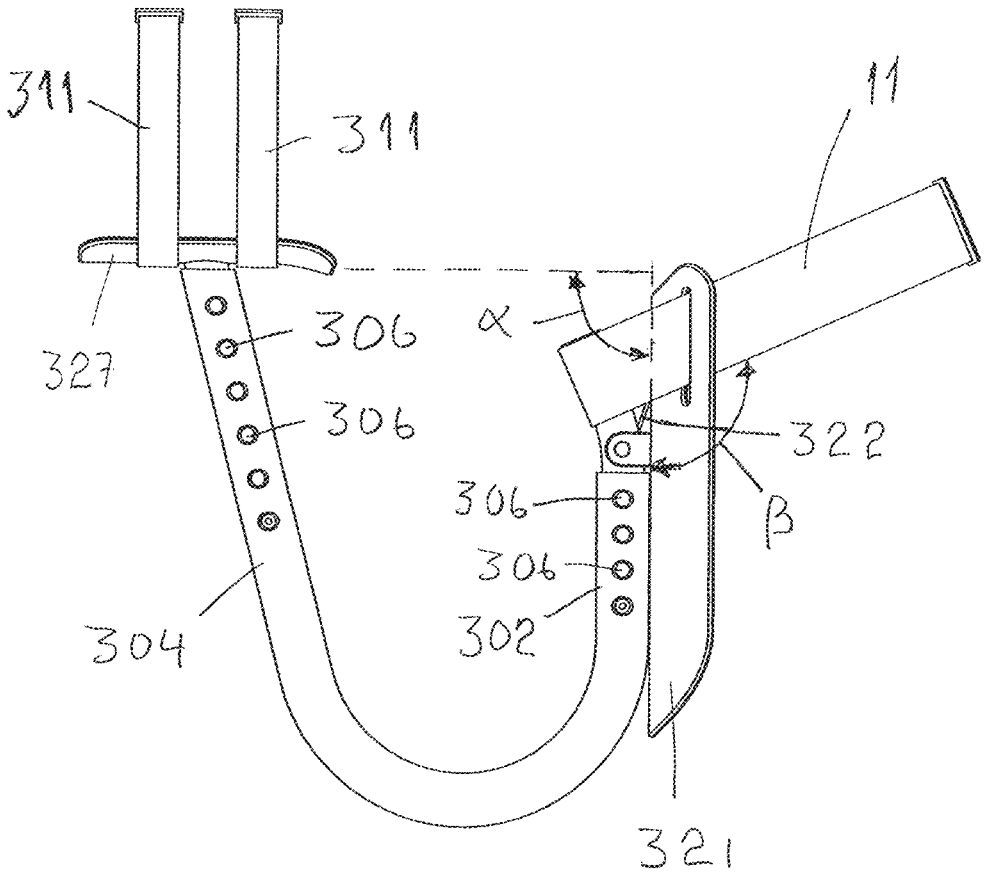
FIG. 12 shows a side view of the fourth embodiment of a device according to the present invention.
Figure 13:
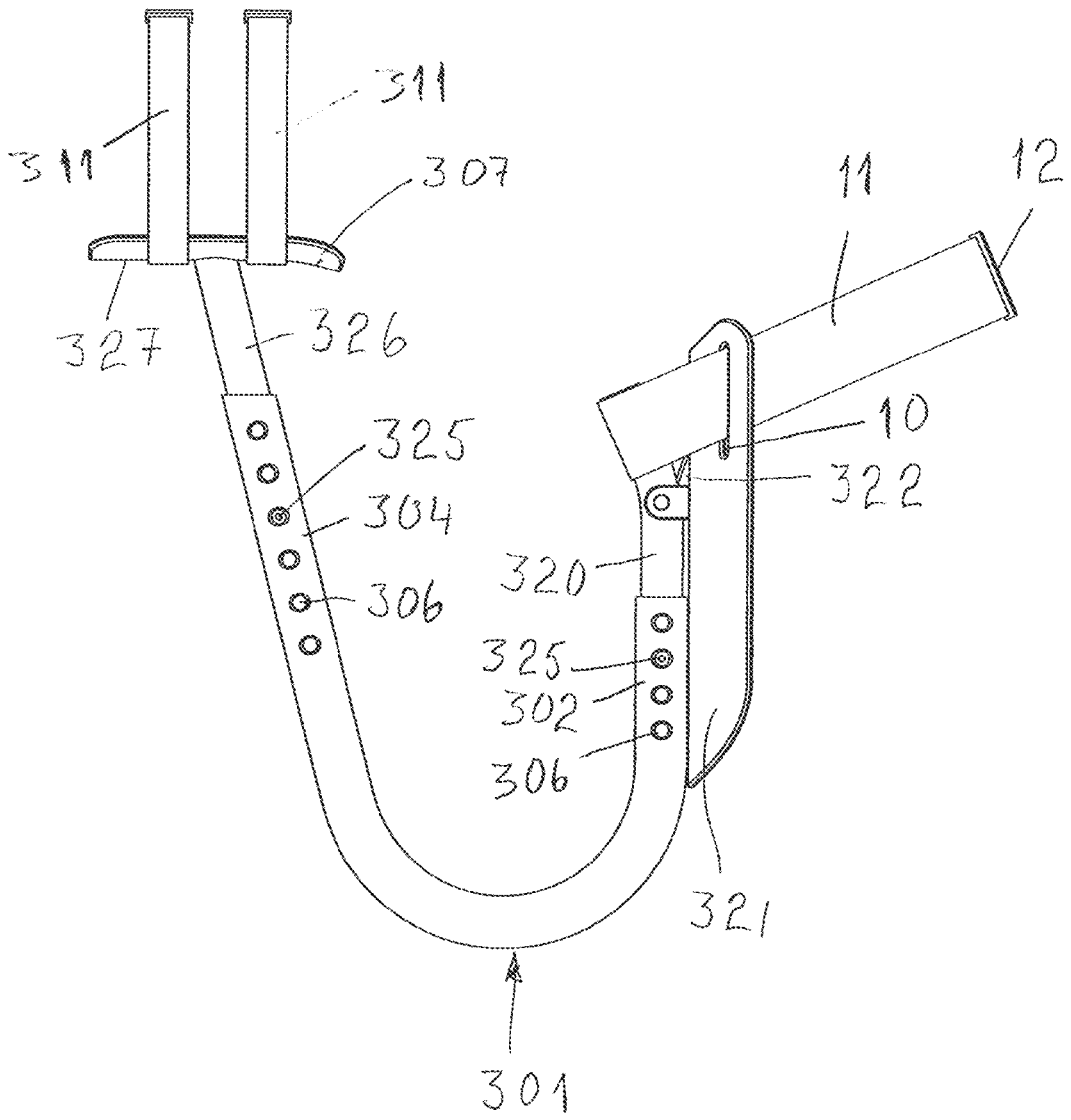
FIG. 13 shows a side view of the fourth embodiment of a device according to the present invention.

In FIGS. 11-13 a further embodiment of a device according to the present invention is disclosed, the device comprising a tubular frame 301 that has U-shape in the disclosed embodiment. One leg 302 of the U is longer than the other leg 304. Each leg 302, 304 is equipped with a number of openings 306 that are arranged linearly with constant spacing from the free ends of the legs 302, 304.

In the first leg 302 a first tube 320 is telescopically received, see FIG. 13, and a first hollow supporting plate 321 is pivotally connected to the portion of the first tube 320 that is located outside the first leg 302. The first hollow plate 321 defines a first supporting surface 305 to carry one of the thighs of the user. The first hollow plate 321 is allotted a spring 322, see FIGS. 12 and 13, that urges the lower part in FIGS. 12 and 13 of the first hollow plate 321 against the first leg 302.

The first hollow plate 321 is equipped with two (only one disclosed in the figures) slots 10 that receive a band 11 with a buckle 12. The band 11 also extends around a somewhat bent end portion of the tube 320. Thus, the band 11 is given an orientation to be located in the vicinity of the knee of the user when the band 11 is in an active position.

The internal diameter of the first leg 302 is adapted to the external diameter of the first tube 320 in order to allow the first tube 320 to be easily displaceable relative to the first leg 302 and simultaneously guided by the first leg 302. There should be sufficient rigidity between the first leg 302 and the first tube 320.

The first tube 320 is equipped with a locking mechanism 325 that constitutes a spring loaded knob that will click into any of the openings 306 chosen by the user and thus locks mutual displacement between the first tube 320 and the first leg 302.

In the second leg 304 a second tube 326 is telescopically received, see FIG. 13, and a second hollow supporting plate 327 is rigidly connected to the portion of the second tube 326 that is located outside the second leg 304. The second hollow plate 327 defines a second supporting surface 307 for carrying one lower leg of the user.

The second hollow plate 327 is equipped with two tightening bands 311 that in active position extend around the lower leg of the user.

The second tube 326 is equipped with the corresponding locking mechanism 325 as the first tube 320. Thus, the spring loaded knob may in a corresponding way click into a chosen opening 306 of the second leg 304.

Since the position of both the first plate 321 and the second plate 327 is adjustable the positions of the plates 321 and 327 may be adapted to the user. This is evident by a comparing study of FIGS. 12 and 13.

The hollowness of the first plate 321 and the second plate 327 defines grooves having an extension in the plane of the paper in FIGS. 12 and 13.

In FIG. 12 the angle α between the supporting surfaces 305, 307 is marked. However, the angle α may vary since the first hollow plate 321 is pivotally attached to the first tube 320.

Figure 14:
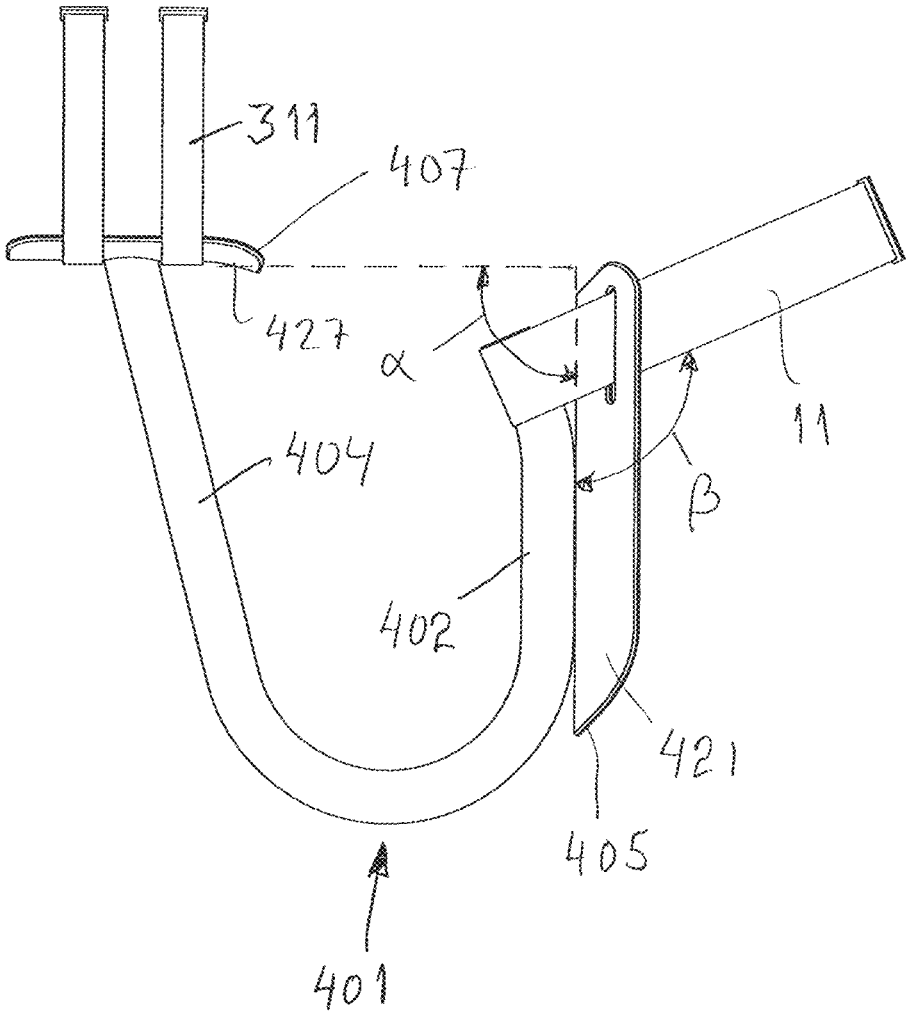
FIG. 14 shows a side view of a fifth embodiment of a device according to the present invention.

In FIG. 14 a further embodiment is disclosed, said embodiment being a variant of the embodiment according to FIGS. 11-13. This device has a frame 401 that generally is U-shaped, this frame may be a tubular frame but also a frame of a bent rod of for instance wood. The frame 401 is not equipped with openings and does not receive tubes in a telescopic manner in its legs. Thus, the embodiment according to FIG. 14 is not adjustable but the first hollow plate 421 is fixed on the side of the first leg 402, e.g. by welding or by gluing, and the second hollow plate 427 is rigidly attached, e.g. by means of welding or by gluing, to the end of the second leg 404. The angle α between the supporting surfaces 405, 407 is thus fixed.

Figure 15:
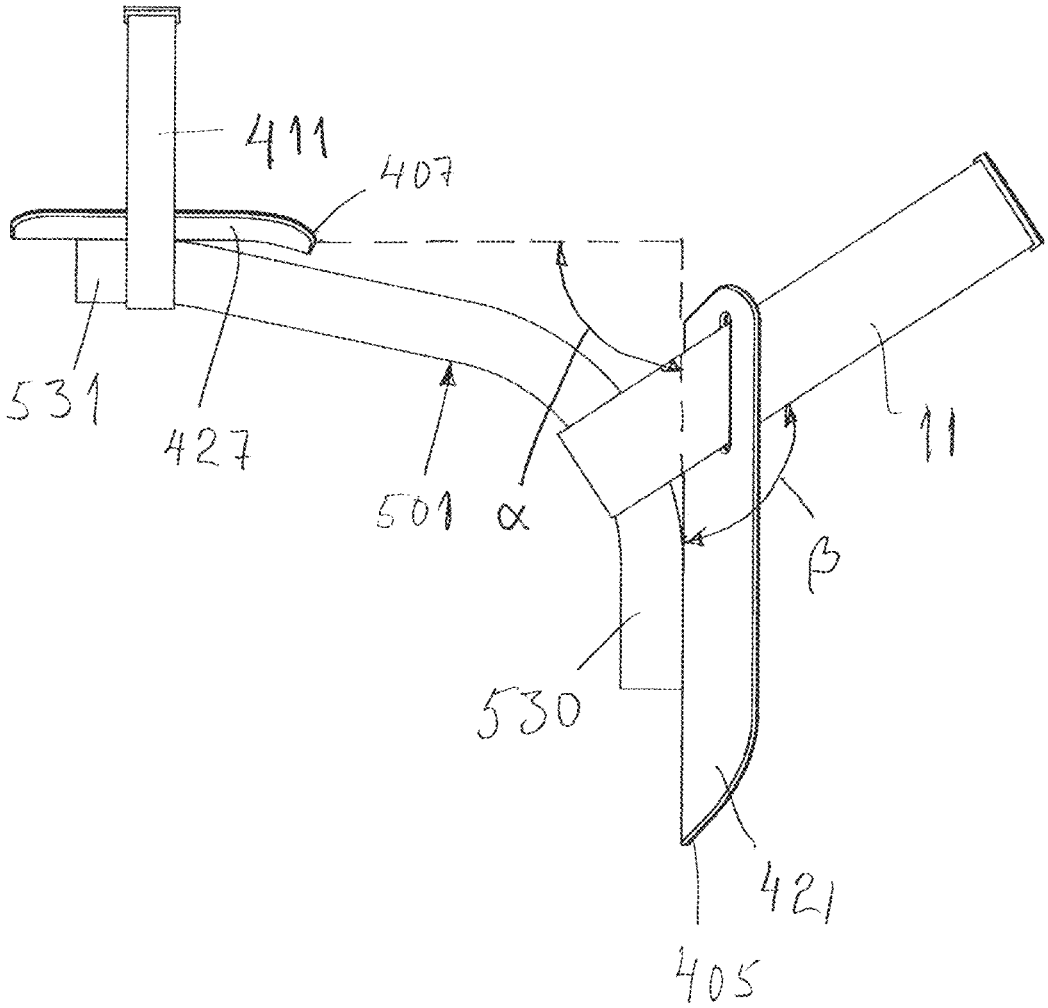
FIG. 15 shows a side view of a sixth embodiment of a device according to the present invention.

In FIG. 15 a further embodiment of the present invention is disclosed, said embodiment being a variant of the embodiment disclosed in FIG. 14. In this embodiment the frame is L-shaped and also in this case the frame may be a tubular frame or a frame in the shape of a bent rod of for instance wood. The first hollow plate 421 is attached, e.g. by means of welding or gluing, on the side of one leg 530 of the L while the other hollow plate 427 is attached, e.g. by means of welding or gluing, on the side of the second leg 531 of the L. The hollow plates 421, 427 are each allotted a band 11, 411. The angle α between the supporting surfaces is fixed.

As regards selection of material concerning the embodiments disclosed in FIGS. 11-15 both metal and plastic or combination of said materials is feasible. As regards the embodiments according to FIGS. 14 and 15 also wooden based materials, e.g. bent wood, are feasible as mentioned above.

Figure 16:
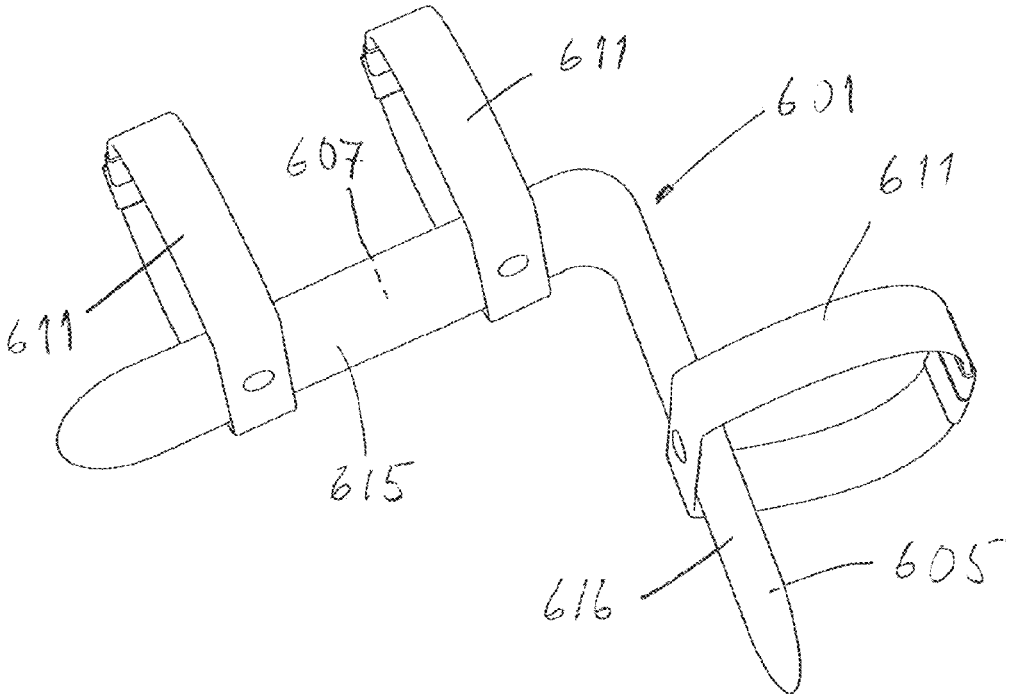
FIG. 16 shows a perspective view of a seventh embodiment of a device according to the present invention.
Figure 17:
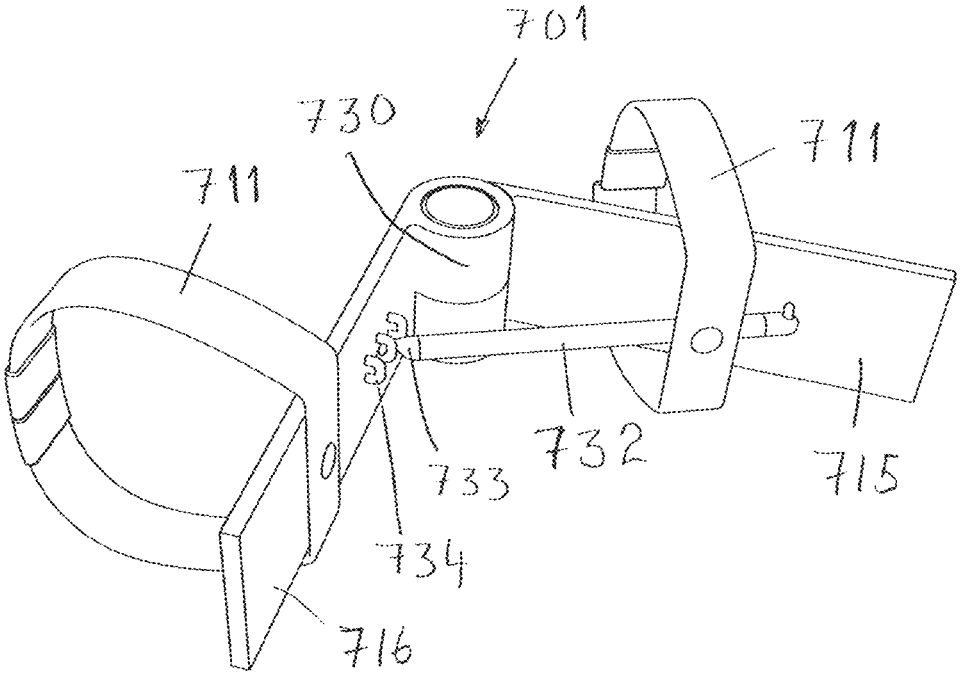
FIG. 17 shows a perspective view of an eight embodiment of a device according to the present invention.
Figure 18:
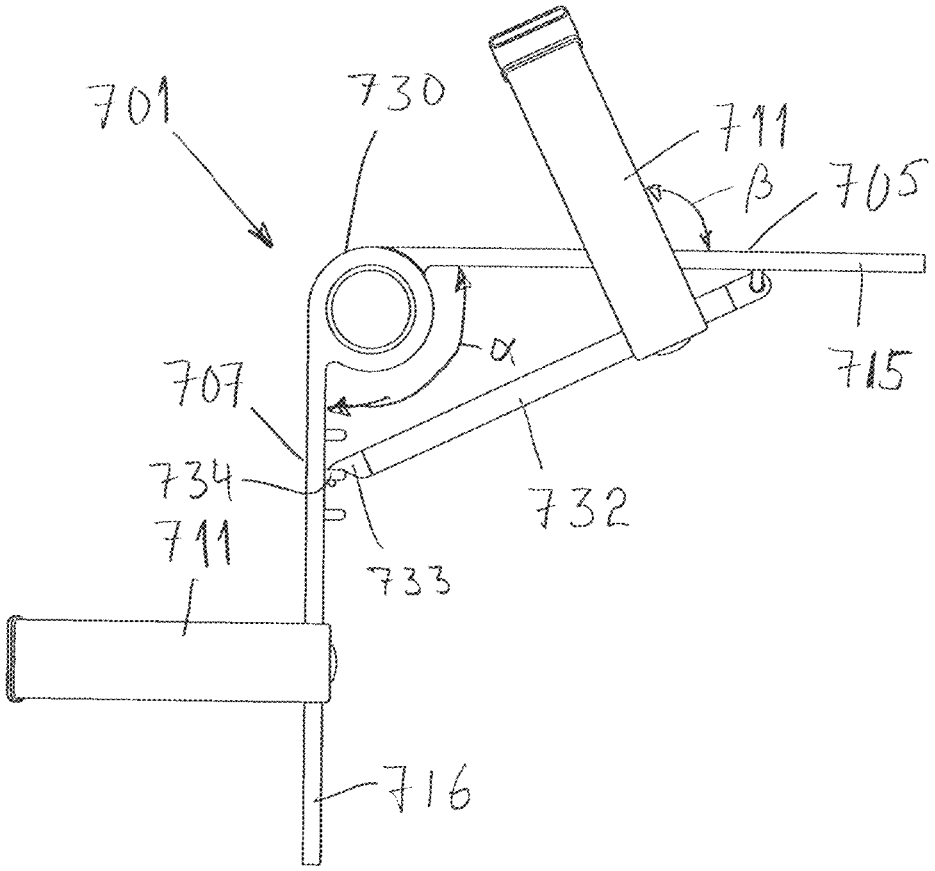
FIG. 18 shows a side view of the device according to FIG. 17.
Figure 19:
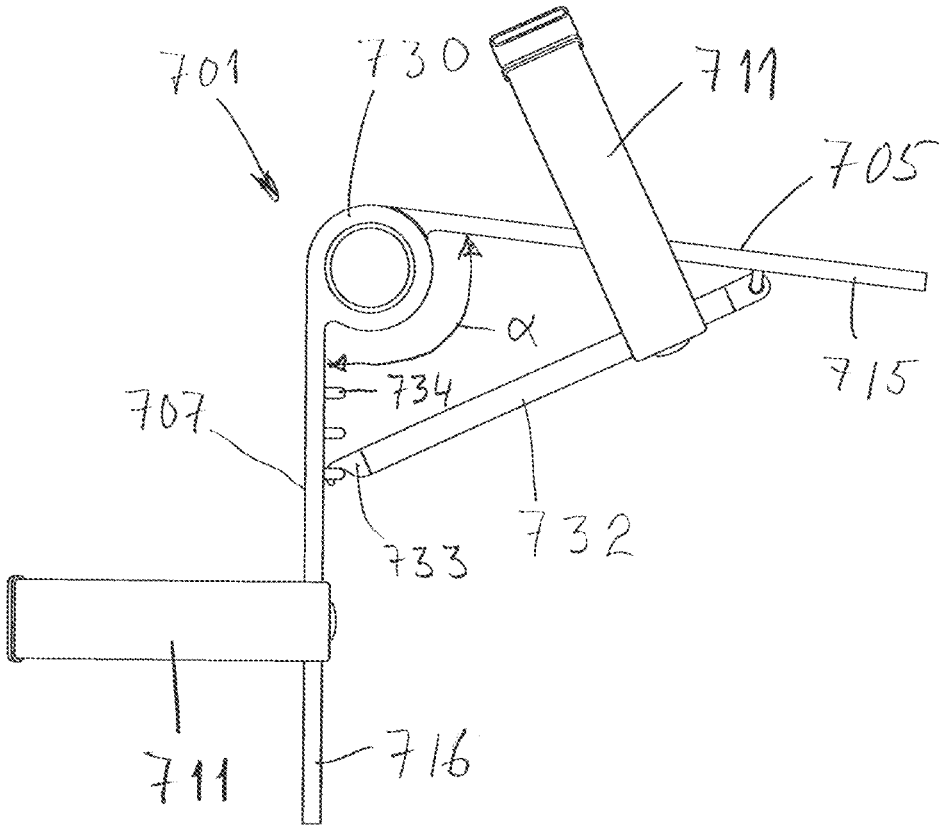
FIG. 19 shows a side view of the device according to FIG. 17.

In FIG. 16 a further embodiment of the device according to the present invention is disclosed, the base body 501 generally having L-shape or V-shape. The base body 601 comprises two legs 615 and 616 and said legs 615, 616 define an intermediate angle α that preferably corresponds to the angle α in the embodiments described above, i.e. the angle α preferably assumes the same values as has been mentioned regarding the above described embodiments.

In a corresponding way as for the embodiments described above the base body 601 defines two edge surfaces 605 and 607 respectively on the sides of the legs 615, 616 that faces away, said edge surfaces also defines an intermediate angle α in the area of the connection between the legs 615, 616. In a corresponding way as for the embodiments described above said edge surfaces constitute supporting surfaces for one leg of the user when the device is mounted in the fold of the knee of the user.

On one leg 616 a band 611 is mounted and on the other leg 615 two bands 611 are mounted, said bands 611 being intended to be used for fastening of the device in the fold of the knee of the user, the bands 611 extending around the lower leg and thigh respectively of the user in a corresponding way as is disclosed in FIG. 4.

The device according to FIG. 16 may be manufactured from a suitable metal, a suitable plastic or a wooden based material, e.g. bent wood. Also a combination of metal and plastic is feasible. In this connection it should be pointed out that with a suitable selection of material the connection between the legs 615, 616 may be somewhat flexible, i.e. the angle α between the legs 615, 616 may vary to a certain degree when the legs 615, 616 are carrying one leg of the user.

In FIG. 17-20 a further embodiment of a device according to the present invention is disclosed where the base body 701 comprises two legs 715, 716 that are mutually connected by means of a hinge 730, i.e. the legs 715, 716 are pivotally connected to each other. This brings about that the angle α, see FIGS. 18-19, may vary. In order to regulate the angle α the device is equipped with a supporting means in the shape of a rod 732 that is pivotally attached to one leg 715. The end of the rod 732 that faces away from the pivot attachment is equipped with a hook 733, see FIGS. 17-20. This hook 733 is intended to cooperate with a number of loops 734 that are provided on the other leg 716. By choosing a suitable loop 734 and engage the hook a certain angle α may be defined between the legs 715, 716.

As regards the angle α of the embodiments according to FIGS. 16 and 17-20 said angle preferably is of the same magnitude as has been defined for the embodiments described above.

In a conventional way the device according to FIGS. 17-20 is equipped with bands 711 for attachment of the device in the fold of the knee of a user.

Figure 20:
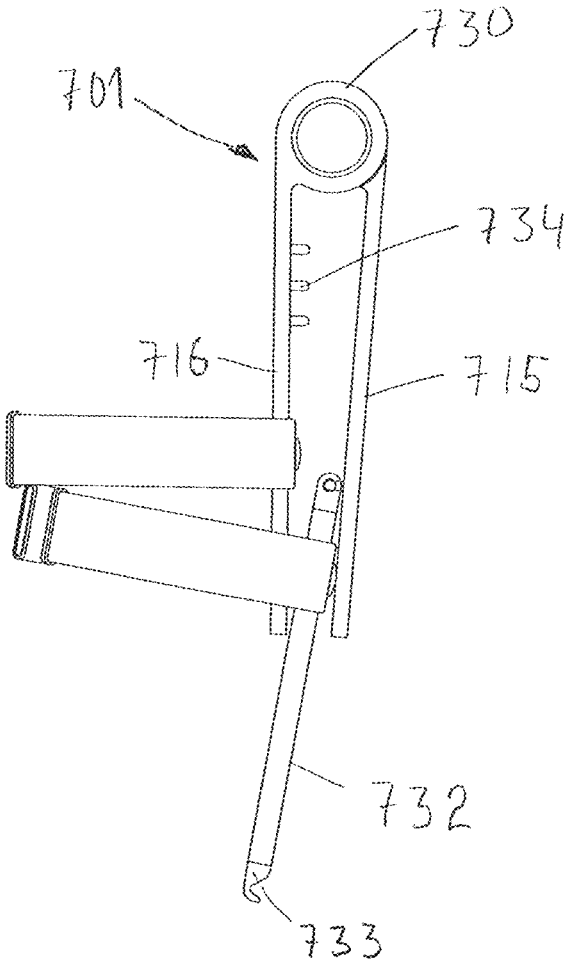
FIG. 20 shows a side view of the device according to FIG. 17, the device being in folded position.

In FIG. 20 the device according to the present invention is disclosed in folded position and the hook 733 of the rod 732 is not engaging any loop 734. The legs 715, 716 are essentially parallel to each other.

Figure 21:
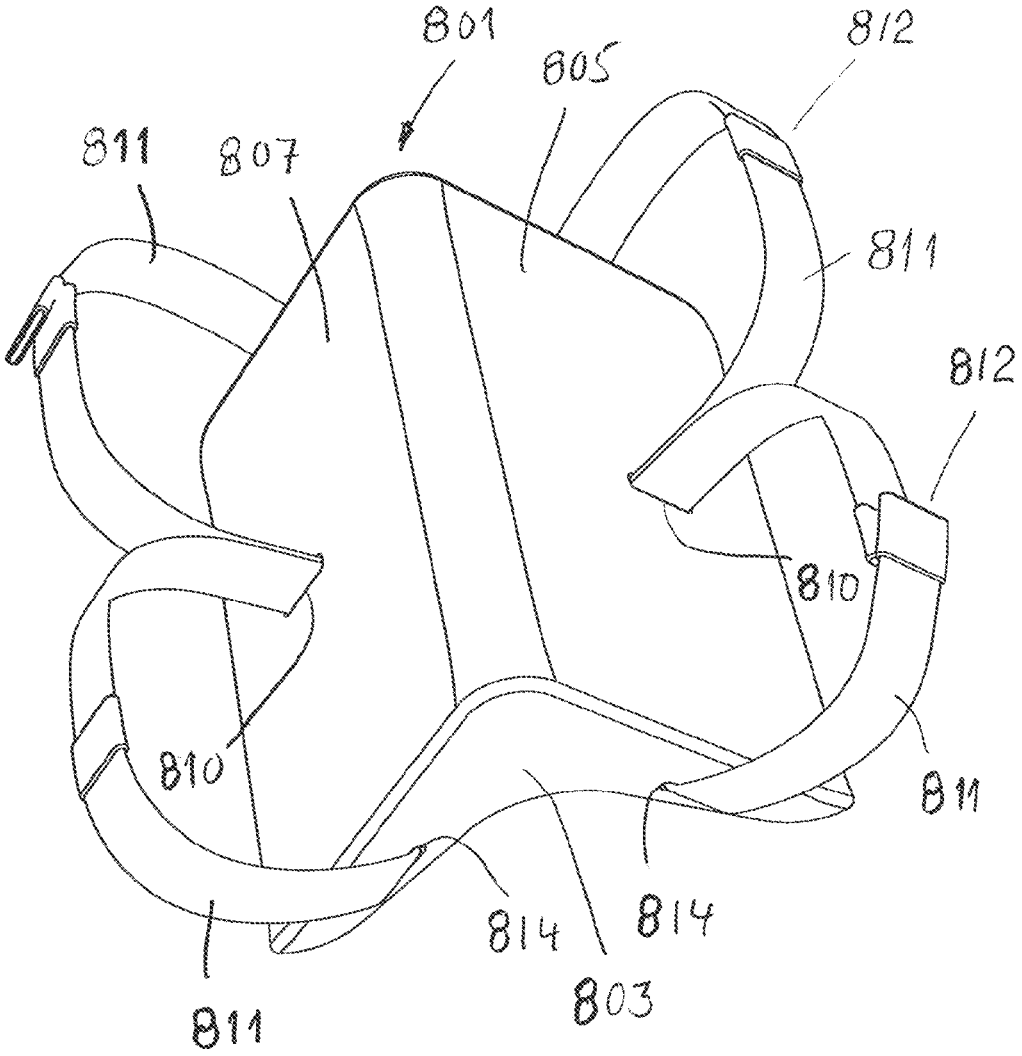
FIG. 21 shows a perspective view of a ninth embodiment of a device according to the present invention.
Figure 22:
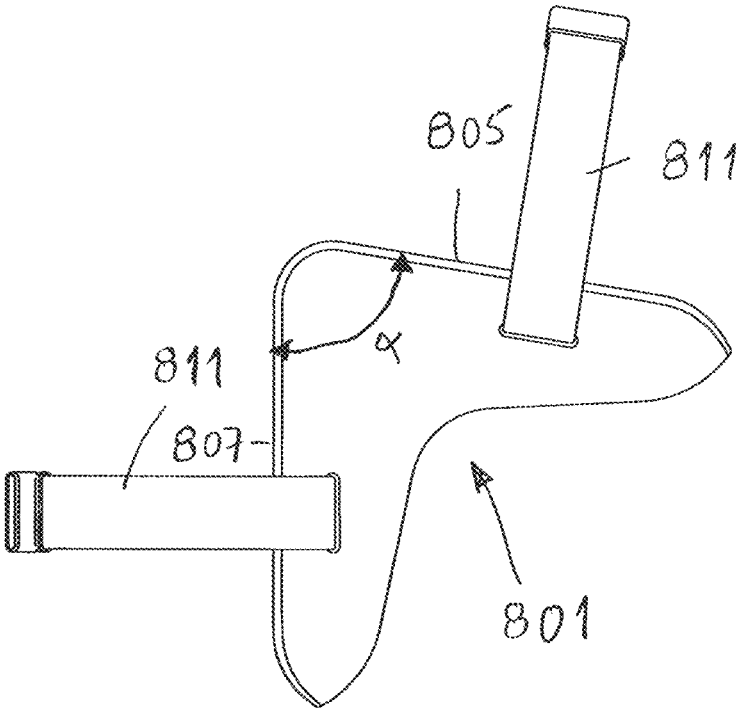
FIG. 22 shows a side view of the device according to FIG. 21.

In FIGS. 21-22 a further embodiment of the invention according to the present invention is disclosed, the device comprising a base body 801 that generally is V-shaped. On the outer side of the legs of the V the base body 801 defines two planar edge surfaces 805, 807. The base body 801 also comprises two opposite side surfaces 803 that are parallel, generally V-shaped and joins the edge surfaces 805, 807. A principal difference between this embodiment and the embodiments described above is that the embodiment according to FIGS. 21-22 is intended to serve both legs of the user. This is evident from FIG. 21 where four bands 811 are provided in connection to the edge surfaces 805, 807. In the edge surfaces 805, 807 respectively a first slot 810 is provided, said slot having a longitudinal extension parallel to the intersection between the edge surfaces 807 and the side surfaces 803. In each side surface 803 two second slots 814 are provided that also have a longitudinal extension along the intersection between the side surfaces 803 and the edge surfaces 805, 807. The first and second slots 810, 814 communicate with each other so that a band 811 may extend both through a first slot 810 and a second slot 814. As regards the dimensions of all of the slots 810, 814 they have a length that is somewhat larger than the width of the bands 811. As regards the width of the first slots 810 two bands 811 should be allowed to pass through the slot 810 while only one band 811 passes through the second slots 814.

According to the disclosed embodiment the two edge surfaces 805, 807 define an intermediate angle α, see FIG. 22, that according to the disclosed embodiment is acute and more precisely the angle is $80° < \alpha < 90°$.

When mounting the device according to FIGS. 21 and 22 on a user the user preferably assumes a seating position with parallel and angled legs. The device is now applied by means of the four bands 811 that are tightened around both legs. Two of the bands 811 are tightened around the thighs of the user and two of the bands 11 are tightened around the lower legs of the user.

Figure 22A:
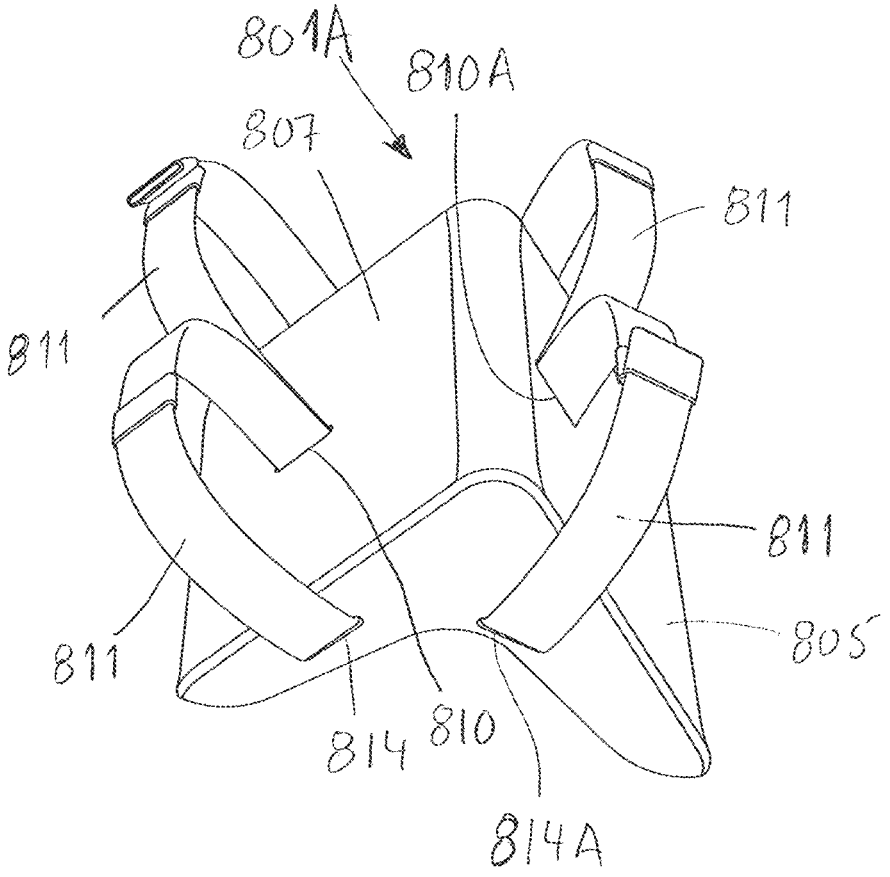
FIG. 22A shows a side view of a somewhat modified embodiment of the device according to FIGS. 21-22.

In FIG. 22A a somewhat modified embodiment of the device according to FIGS. 21-22 is disclosed and the base body has been given the reference numeral 801A. In connection therewith the positions of the slots 810A and 814A (only one slot is shown in FIG. 22A) is somewhat changed compared to the embodiment according to FIGS. 21-22. This is most evident by a comparison between FIGS. 21 and 22A. Thus, the slot 814A is not parallel with the adherent supporting surface 805 but the distance between the slot 814A and the edge surface 805 increases in a direction towards the second edge surface 807. Thereby, the part of the bands 811 that is furthest away from the base body 801A and received in the slots 810A and 814A will be located adjacent to the knee of the user.

As regards the embodiments disclosed in FIGS. 21-22 and 22A the base body 801; 801A may preferably constitute products of polystyrene of the type hard cellular plastic/hard foam plastic, styrofoam, suitable hard plastic.

As regards the supporting surfaces of the embodiments described above the supporting surfaces 5; 105; 205; 305; 405; 605; 705; 805 are intended to carry a thigh of the user while the supporting surfaces 7, 107; 107B; 207; 307; 407; 607; 707; 807 are intended to carry a lower leg of the user.

Feasible Modifications of the Invention

The above described embodiments of the present invention do only constitute examples. The basic shape of the base body 1 may vary in a number of ways. However, the base body should comprise two supporting surfaces 5, 7; 105, 107; 205, 207; 305, 307; 405, 407; 605, 607; 705, 707; 805, 807 that define an intermediate angle α.

In the embodiments described above certain of the supporting surfaces 205, 207; 305, 307; 405, 407 are groove shaped, i.e. concave in a direction transverse to the longitudinal direction of the supporting surfaces. In this connection it should be pointed out that within the scope of the present invention in principle all other supporting surfaces may also be groove shaped.

As regards the embodiment disclosed in FIGS. 17-20 the leg 715 is equipped with one band 711 and the other band 711 is attached to the rod 732. Within the scope of the present invention it is feasible that the first leg 715 is allotted a further band 711 that is located in the vicinity of the hinge 730. Thereby, it may be necessary to move the loops 734 a certain distance further away from the hinge 730. The band 711 that is attached to the rod 732 may instead be attached to the second leg 716.

In this connection it should be pointed out that the base body may also constitute an air-filled casing/shell of flexible material. In air-filled condition the casing/shell defines two supporting surfaces that define an intermediate angle α. The casing/shell may be equipped with a valve in order to allow air to supplied to the casing/shell or discharged from the casing/shell.

Within the scope of the present invention it is also feasible that the base body constitutes a hollow structure where the edge surfaces/the supporting surfaces constitute sheet like elements and the side surfaces also constitute sheet formed elements.

For the embodiments described above the angle α is acute and more precisely it is in the interval $80° < \alpha < 90°$. Within the scope of the invention the angle α may assumes values outside the above defined interval. The limit values that have been considered possible for the angle α to assume within the scope of the present invention are $70° < \alpha < 110°$.

The invention claimed is:

1. A device in connection with exercise, the device comprising:

a base body, the base body comprising a U-shaped tube frame and supporting plates that define two supporting surfaces provided on the tube frame, two legs of the U-shaped tube frame telescopically receive tubes that carries a respective supporting plate, and the legs and the tubes have a cooperating lock in order to fix the tubes relative to the legs of the U-shaped tube frame in a desired position; and one to three bands that form or forms a closed loop relative to the base body, the one to three bands adapted to apply the base body in a fold of a single knee of a user, the device being configured to be fastened in the fold of the single knee only, wherein the two supporting surfaces form an intermediate angle ($\alpha$) that is in an interval $70° < \alpha < 110°$, and wherein the device is adapted to be utilized in connection with sit-up training.

2. The device according to claim 1, wherein the angle ($\alpha$) is acute and is in the interval $80° < \alpha < 90°$.

3. The device according to claim 2, wherein there are two bands, and each supporting surface is coupled to band of the two bands.

4. The device according to claim 2, wherein the one to three bands is at a fixed angle $\beta$ with the adherent supporting surface, and the fixed angle $\beta$ is in the interval $90° < \beta < 130°$.

5. The device according to claim 1, wherein there are two bands, and each supporting surface is allotted at least one band of the two bands.

6. The device according to claim 1, wherein the supporting surfaces are concave transverse to a longitudinal direction of the supporting surfaces.

7. The device according to claim 1, wherein the base body constitutes a U-frame of wooden based material, the supporting plates defining the supporting surfaces are provided on the frame or constitute a part of the frame.

8. The device according to claim 1, wherein the one to three bands form a fixed angle $\beta$ with the adherent supporting surface, and the fixed angle $\beta$ is in the interval $90° < \beta < 130°$.

9. A device in connection with exercise, the device comprising:

a base body comprising a U-shaped tube frame and supporting plates that define two supporting surfaces provided on the tube frame, two legs of the U-shaped tube frame telescopically receive tubes that carries a respective supporting plate, and the legs and the tubes have a cooperating lock in order to fix the tubes relative to the legs of the U-shaped tube frame in a desired position, and the two supporting surfaces form an intermediate angle ($\alpha$) that is in an interval $70° < \alpha < 110°$; and one to three bands for applying the base body in a fold of a knee of a user, at least one band of the one to three bands form a closed loop relative to the base body, wherein the device is adapted to be utilized in connection with sit-up training.

10. The device according to claim 9, wherein the closed loop is formed via buckles.

* * * * *